United States Patent [19]

Abel

[11] 4,124,432

[45] * Nov. 7, 1978

[54] CONVEYING MECHANISM FOR YARNS IN PILE FORMING APPARATUS

[75] Inventor: Martin L. Abel, Franklin, Mich.

[73] Assignee: Permalock Company, Auburn Heights, Mich.

[ * ] Notice: The portion of the term of this patent subsequent to Oct. 28, 1992, has been disclaimed.

[21] Appl. No.: 813,451

[22] Filed: Jul. 7, 1977

Related U.S. Application Data

[63] Continuation of Ser. No. 458,316, Apr. 5, 1974, abandoned.

[51] Int. Cl.[2] ..... D05C 15/00

[52] U.S. Cl. ..... 156/435; 28/212; 156/72

[58] Field of Search ..... 156/72, 435, 178, 434, 156/368, 436; 28/190, 192, 197, 199, 200, 212, 232, 215; 242/125, 157 R; 254/190; 226/186, 188, 168, 181, 177

[56] References Cited

U.S. PATENT DOCUMENTS

| | | | |
|---|---|---|---|
| 3,239,396 | 3/1966 | Bohannon, Jr. | 156/436 |
| 3,387,577 | 1/1968 | Spanel et al. | 156/72 |
| 3,641,696 | 2/1972 | Fleischer | 254/190 R |
| 3,701,700 | 10/1972 | Von Der Heide | 156/72 |
| 3,790,426 | 2/1974 | Bylund | 156/72 |
| 3,942,742 | 3/1976 | Boucher | 242/157 R |

*Primary Examiner*—William A. Powell
*Assistant Examiner*—Michael W. Ball
*Attorney, Agent, or Firm*—Lane, Aitken, Dunner & Ziems

[57] ABSTRACT

A conveying mechanism for a non-woven carpet machine which includes a pair of conveyor belts along each edge of the backing material for pulling the backing material from its roll and pushing it toward a portion of the machine where bonding material is applied to the backing material. Hot air from the curing oven can be directed against the backing material after the bonding material is applied thereto to make the bonding material tacky so that when yarn is embedded in the bonding material it will not easily be pulled out.

A mechanism for advancing the backing material includes means for intermittently pulling the backing layers at a constant rate of speed through the well of the machine and oven and past the cutting mechanism, while a pin roller engages the backing material before the well. An adjustable torque controlled motor is connected to the pin roller so that a constant tension is maintained in the backing material.

5 Claims, 5 Drawing Figures

CONVEYING MECHANISM FOR YARNS IN PILE FORMING APPARATUS

This is a continuation of application Ser. No. 458,316, filed Apr. 5, 1974, now abandoned.

BACKGROUND OF THE INVENTION

This invention relates to machines for making non-woven bonded carpeting by forming a plurality of accordion-like chains of yarn between two backing layers and then severing the yarn between the layers to form two carpets and, more particularly, to the portion of such a machine that conveys the backing layers from their rolls to the point where the yarn is bonded to the backing layers.

Machines have been developed for making carpeting by folding a number of strands of yarn in a row simulataneously and planting them in a layer of adhesive spread across the surface of a sheet of backing material, and then repeating the operation on an opposing parallel sheet of backing material. This is done to form a series of accordion-type loops from each strand of yarn so that a plurality of lengths of material are bonded between the backing layers. After the adhesive has been cured, the loops are severed midway between the backing layers to form two separate carpets. Alternatively, individual lengths of yarn can be severed and one end planted in an adhesive coating on one backing layer and then another backing layer can be applied later to the other ends. Another type of machine has been developed in which the loops of yarn are formed initially without bonding them to the backing layers, and adhesive is applied later to the yarn.

In these types of operations, the adhesive can be used as the backing layer in addition to being the means for anchoring the yarn in place.

When a backing material is used, it is normally formed of woven strands of jute, although there are many other suitable types of backing material. The bonding material can be an adhesive such as a liquid synthetic resin which has been applied to the backing sheets or directly to the yarn. Ployvinylchloride (PVC) has been found to be effective.

In most machines, a roll of backing material is mounted on each side of the machine and the two webs of material are continuously advanced toward a well where they are disposed with one surface of each web parallel to a surface on the other web. Adhesive is applied to the layers as they are being advanced, the adhesive-coated surfaces facing each other in the well. At or near the top edge of the well a weaving mechanism such as the one shown and described in my copending U.S. application Ser. No. 323,440, filed Jan. 15, 1973, now U.S. Pat. No. 3,915,789, plants the yarn in the adhesive on one backing layer and then in the adhesive on the other backing layer to form what is known as yarn "sandwich." The sandwich passes through an oven to cure the adhesive and anchor the yarn to the backing layers. The yarn strands are then severed at some point between the backing layers to form two separate carpets. Any appropriate cutting mechanism can be used such as the ones shown and described in my copending U.S. application Ser. No. 315,845, filed Dec. 18, 1972, now abandoned and Ser. No. 425,890, filed Dec. 18, 1973, now U.S. Pat. No. 3,957,568 entitled "Cutter for Non-Woven Carpet Machine."

One problem in designing and building such machines is that oftentimes limited space conditions or the desire to eliminate expensive lifting mechanisms for the heavy rolls of backing material make it advantageous for the rolls to be mounted below the well, resulting in the material being conveyed upward from the roll. In prior art machines this is done by simply pulling the backing material from the roll toward the well. When a backing material such as jute is used this pulling upward requires a heavier grade material then is needed to form satisfactory carpeting so that the jute or other backing material is not torn or distorted by the pulling forces. A lighter grade of jute can be used for bonded carpeting than for example tufted carpeting because the adhesive used in bonded carpeting adds extra strength and durability to the backing layer. The lighter grade jute is advantageous because it significantly lowers the cost of the final product.

In addition, the alignment of the backing material in the direction of movement must be maintained as it moves toward the well. This must be done so that there is no lateral shifting which would result in a non-uniform final product and require an additional costly trimming step.

SUMMARY OF THE INVENTION

In accordance with the invention, a unique conveying and training mechanism for the backing layers is provided that solves the problems discussed above. In order to simplify the following discussion, the invention will be described with jute as the backing material but it should be understood that other suitable materials can also be used in conjunction with the invention.

The mechanism includes a pair of cooperating conveyor belts for each edge of each web of jute, the cooperating belts engaging and pushing the jute toward a horizontal plate where adhesive such as PVC is applied. This pushing action eliminates most of the forces in prior art machines that caused the lighter grades of jute to become torn and distorted.

The two pairs of conveyor belts are either driven by the same motor or by synchronized motors so that the belts along each edge of the same web will travel at the same speed. In this way the jute will remain aligned in the direction of travel. Moreover, means can be provided for detecting when the jute shifts to one side or the other so that the conveyors on one side can be speeded up or slowed down to realign the jute. Other means can be provided to ensure that the jute remains aligned, such as a mechanism for moving the jute roll back and forth.

A stationary rack or frame is located between the pairs of conveyors to support the jute as it is being pushed toward the well. This prevents the jute from sagging between the conveyors and causing a pulling force toward the center of the advancing jute web.

After the jute leaves the conveyors it travels across a horizontal plate where adhesive is applied. Heat can be directed against the underside of the plate from the curing oven so that the adhesive becomes tacky enough to hold the yarn in place during the yarn planting step. This can be done by providing thermostatically controlled dampers at the top of the oven.

The jute is pulled through the machine after it leaves the conveyors by means of a drive roller located below the cutter. A drive roller engages the jute, which by this time has been formed into carpeting, and pulls it across the upper horizontal plate, through the well and oven and past the cutter. This roller is driven at a constant predetermined rate of speed.

A pin roller is located between the conveyors and the plate, which engages the jute by means of a plurality of sharp pins projecting from the outer surface of the roller. The pin roller is driven by an automatically adjusting, SCR drive, torque controlled motor and operates as a brake on the drive roller; this is that when the drive roller is pulling too hard or not hard enough on the jute the pin roller senses this condition and automatically speeds up or slows down to maintain the proper tension in the jute.

The motors that drive the conveyors are also adjustable torque-controlled motors so that the conveyors will react to changes in speed of the pin rollers. In this way, the jute is intermittently advanced at a nearly constant rate of speed and maintained under nearly constant tension.

BRIEF DESCRIPTION OF THE DRAWING

For a better understanding of the invention, reference may be had to the following description of an exemplary embodiment taken in conjunction with the accompanying drawings, in which.

DETAILED DESCRIPTION OF EXEMPLARY EMBODIMENTS

Figure 1:
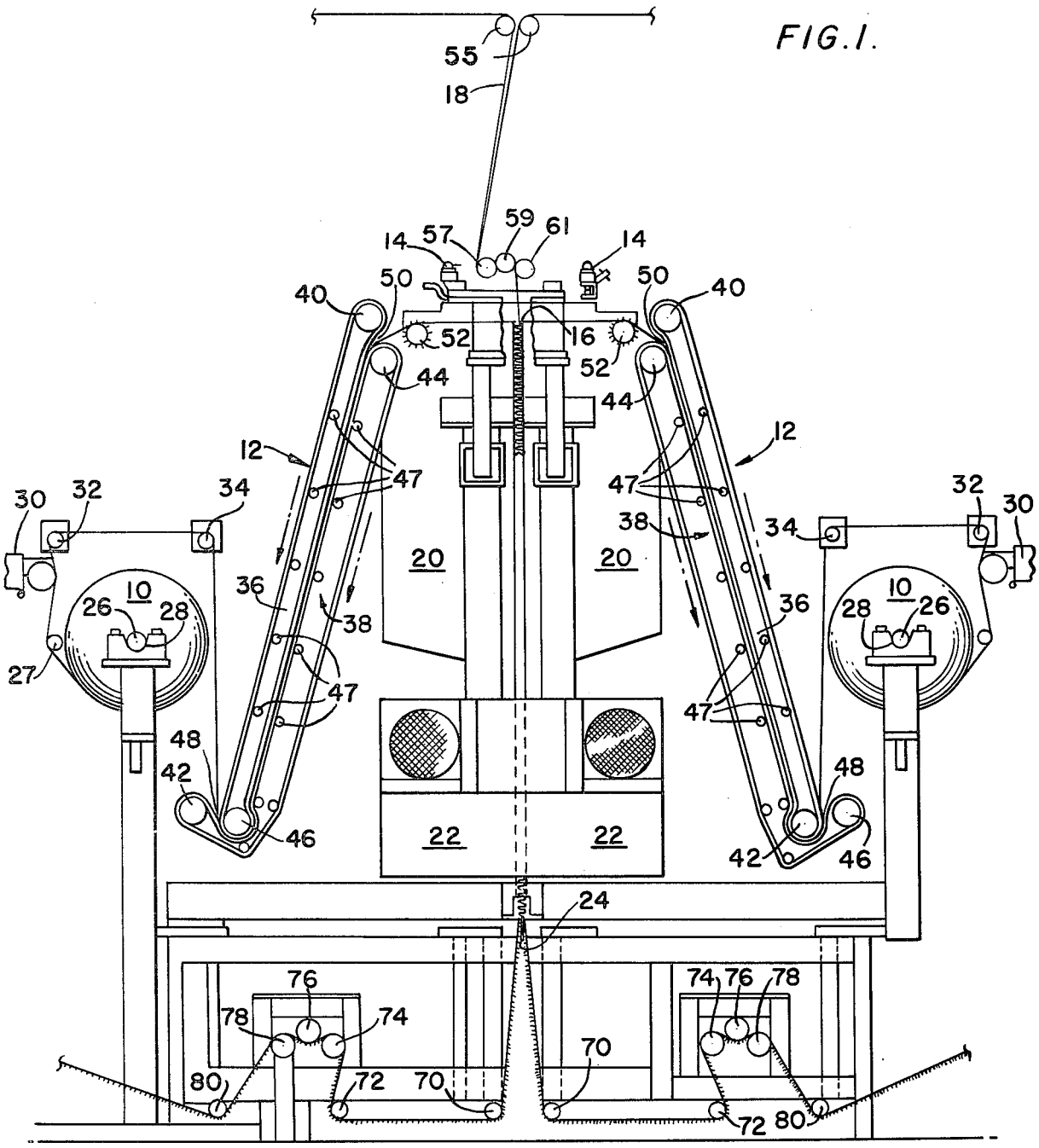
FIG. 1 is a front view partially in section of the non-woven carpet machine, showing in particular the backing layer conveying mechanism.
Figure 2:
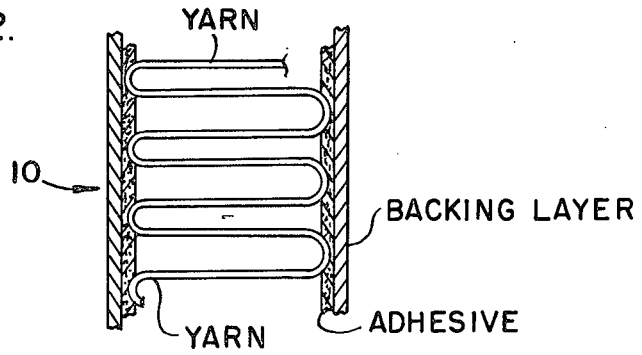
FIG. 2 is an exaggerated schematic view that shows the yarn sandwich where the strands of yarn are embedded in PVC coated on both backing layers.

Now, refering to the drawings, an exemplary embodiment of the invention will be described in detail. In general, as shown in FIG. 1, the machine is constructed so that a backing material such as jute is provided in large rolls such as those designated by reference numeral 10. The jute is advanced from the roll 10 through the conveying mechanism 12 and across the top of the machine where PVC or other suitable adhesive is applied through the nozzles 14 to the upper side of the jute. The PVC is spread out into a uniformly thick layer by means of a doctor blade (not shown). The layers of jute are then advanced into the well 16 where the PVC coated surfaces of the jute faces each other and are parallel. At or near the upper portion of the well 16 a weaving mechanism alternately plants a plurality of strands of yarn 18 in the PVC on one side of the well and then in the PVC on the other side of the well to form a chain of accordion-type loops of yarn between the backing layers to form what is known as a yarn "sandwich." Such a sandwich is shown in exaggerated fashion in FIG. 2. The weaving mechanism may be similar to the one shown in my U.S. patent application Ser. No. 323,440, filed Jan. 15, 1973. However, other methods and apparatus for forming the sandwich are contemplated as falling within the scope of the invention.

After the sandwich 10 is formed it passes through the oven 20 where heat is applied to the backing layers to cure the PVC and anchor the yarn 18 in place. After the sandwich emerges from the oven it passes through the cooling chamber 22 which can be similar to the one shown and described in my U.S. patent application Ser. No. 425,890, filed Dec. 18, 1973 entitled "Cutter for Non-Woven Carpet Machine." The purpose of the cooling unit 22 is to cool and harden the PVC sufficiently so that when the strands of yarn are cut they will be anchored firmly in place and not be pulled out of the PVC during the cutting step. In addition, the cooling mechanism will also cool the sandwich, neutralize heat from the oven, and provide enough cooling air to dissipate frictional heat which may occur between the cutting blade and the yarn.

After passing through the cooling chamber the sandwich is severed to form two separate carpets. This is done by means of a cutting blade such as the one generally shown in FIG. 1 and designated by reference numeral 24. This cutter may be in a form of band-saw, but other suitable types of cutting mechanisms can be used. Two types of suitable cutters are described and shown in my U.S. patent applications Ser. Nos. 315,845, filed Dec. 18, 1972, and 425,890, filed Dec. 18, 1973 entitled "Cutter for Non-Woven Carpet Machine." After the two carpets are formed each one is rolled up on its own separate roll (not shown) and represents a final product.

The rolls of jute 10 are rotatably mounted on the shafts 26 which are supported in the bearings 28 so that the rolls 10 can easily turn. As the jute is unwound from the roll 10, it passes over the rotary rollers 27 and its edges are trimmed by means of the trimmers 30. The rollers 27 maintain the jute in position for the trimming operation. The trimmers 30 can be of any suitable design, such as the ones shown in schematically in FIG. 1 where a rotary blade is used. In this way, a uniformly wide web of jute can be fed into the machine, which eliminates the necessity to trim the carpet later.

Figure 3:
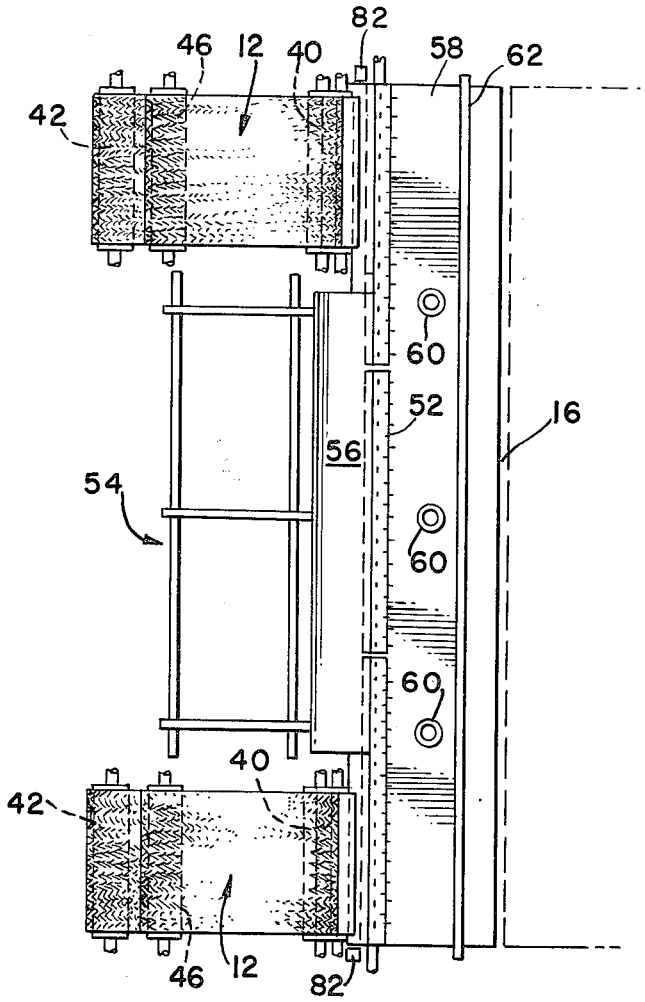
FIG. 3 is a top plan view of one side of the backing layer conveying mechanism.
Figure 4:
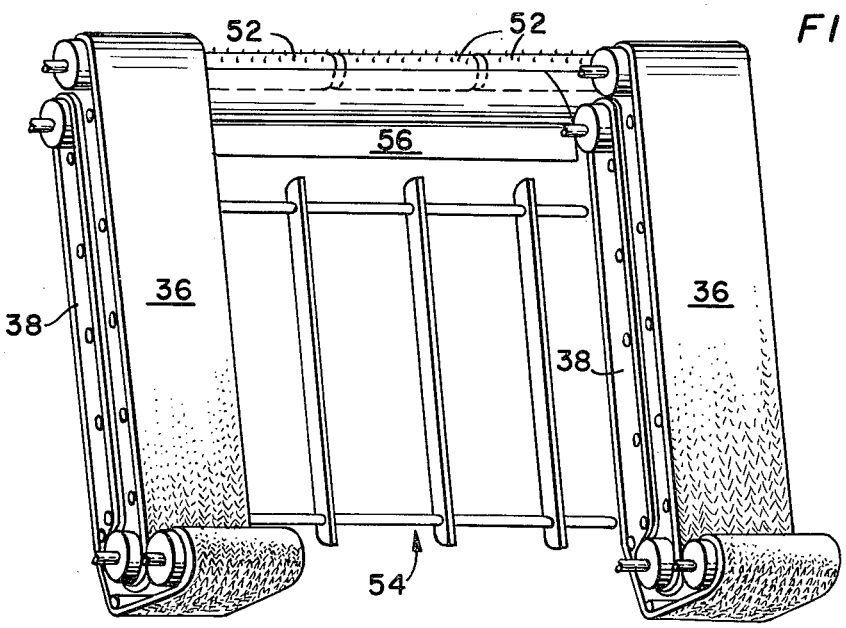
FIG. 4 is a perspective view of the conveying mechanism.

After the jute is trimmed, it passes over the rotary pipes 32 and 34 and into the conveying mechanism 12. As best shown in FIGS. 3 and 4, the conveying mechanism 12 for each layer of jute includes two pairs of endless belt conveyers, each pair being made up of the conveyers 36, 38. The conveyer belts are approximately 1 foot wide and formed of a special rubber surfaced material called "rough-top belting." The drive and idler rollers for each conveyer are approximately 15 inches in width. As best shown in FIG. 1, the conveyer 36 moves between the drive roller 40 and the idler roller 46, and the conveyer 38 moves between the drive roller 44 and the idler roller 42. A plurality of supporting rollers 47 are also provided for each conveyer.

The jute enters the conveying mechanism at the pinch point 48 which is between the portion of the conveyer 36 that engages the drive roller 46 and the conveyer 38. The jute is engaged by the belts and moves between them. This results in a pushing force on the jute to move it upwardly to the upper portion of the machine. The jute leaves the conveying mechanism at the pinch point 50 which is between the portion of the conveyor 36 that engages the drive rollers 44 and the conveyor 38. It should be noted that positioning of the rollers at each pinch point results in tension in the belts so that they firmly engage the jute to keep it moving. As the jute travels between the belts from pinch point 48 to the pinch point 50, the belts engage the jute just enough to exert a pushing force and to keep it moving straight.

After the jute leaves the conveying mechanism it passes over the pin roller 52 which is a roller formed of steel with a plurality of pins projecting from its outer surface which are approximately 1 inch on center with adjacent rows staggered. The pins engage the jute and the pin roller operates in conjunction with the rest of the conveying system as will be described in detail below.

As shown in FIGS. 3 and 4, the conveyers 36, 38, are located only along the edges of the jute. A supporting rack 54 is located between the two pairs of conveyers to prevent the jute from bowing in the middle. A guide plate 56 is provided for guiding the jute onto the pin rollers from the rack 54. It has been found that portions of the guide plate 56 should also be located between the conveyers and the pin roller 52 to prevent the jute from dropping into the space between them. The rack 52 and plate 56 are aligned with the point of contact of the belts on the conveyers 36, 38, so that the jute will be kept as straight as possible as it is pushed upward.

After the jute passes over the pin roller 52, it moves along the upper plate 58 where PVC or other suitable bonding material is applied to the upper surface of the jute through the nozzles. The PVC is contained in large drums and appropriate pumping apparatus, such as a ram which exerts pressure on the PVC in the drum, transmits the PVC from the drums to the nozzles. The nozzles are spaced apart at predetermined distances across the plate 58 and the PVC can be applied by a "puddling" process, where a predetermined amount of PVC at the proper viscosity is forced through the nozzle 14 intermittently. This can be done by providing a removable plug in the nozzle opening and moving the plugh by appropriate means such as a piston movable by compressed air to allow the PVC to flow under pressure onto the jute at timed intervals. The PVC is maintained at such a consistency that it will spread rapidly across the jute. A doctor blade (not shown) is provided downstream from the nozzles 14 to maintain the PVC at a uniform level relative to the upper surface of the sheet of the jute. As will be described in detail below, a damper is provided in the top of the oven 20 so that heat from the oven will heat the plate 58 (see FIG. 5) and cause the PVC to become tacky before it enters the well 16 so that the yarn will remain embedded in the PVC after it has been planted.

After the PVC coated layers of jute enter the well, a weaving mechanism such as wires extending across the entire width of the well will operate to engage and plant the strands of yarn 18 into the PVC on one side of the well and then into the PVC on the other side of the well to form a plurality of accordion-like chains between the backing layers. This type of yarn folding mechanism is disclosed in my pending U.S. application Ser. No. 323,440, filed Jan. 15, 1973. Other types of mechanisms may also be used in conjunction with the invention herein.

The yarn is fed from a number of rolls (not shown) between two rotary pipes 55 which are spaced approximately 1 inch apart (see FIG. 1). The yarn then travels over an idler roller 57 to a point between it and the drive roller 59, where the yarn is pinched by both rollers and advanced by movement of the drive roller. The yarn then travels down between the drive roller 59 and the guide roller 61 which is of the type known as a "comb roller." The comb roller 61 is a roller formed of steel with a plurality of grooves formed in its outer surface, one groove for each strand of yarn with the yarn moving between each groove and the drive roller 59. The drive roller 59 and the guide roller 61 engage each other to hold the yarn in the grooves. The yarn is then continuously fed into the well so that the planting can take place.

Figure 5:
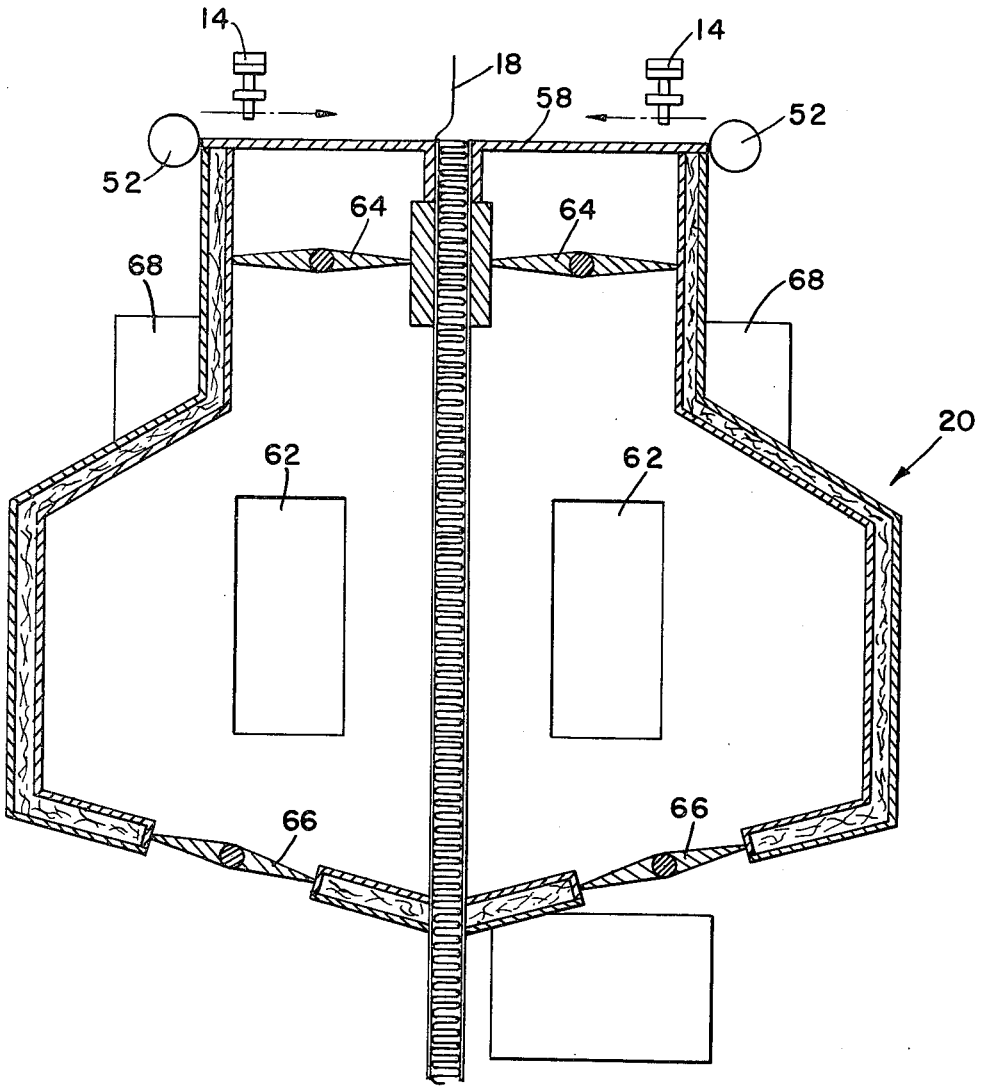
FIG. 5 is a side sectional view of the oven.

After the yarn sandwich is formed, it travels into the oven 20 which is shown in detail in FIG. 5. The oven 20 is formed of outer steel plates with 1-inch fiberglass insulation inside them. Heat is provided by gas fired heating elements, shown schematically and designated by reference numeral 62, which generate heat at about 1,800° F. The heating elements are adjustable in the horizontal plane so that the heat at the outer surface of the backing layers can be controlled. It has been found that heat at about 250°–300° F. for 3–3½ min. is sufficient to cure PVC.

The oven 20 is also provided with dampers 64 which can be opened and closed to regulate the amount of heat that is applied from the oven against the upper guide plates 58. It has been found that the temperature on the upper guide plate should be kept a little below 120° F. so that the PVC is tacky before the coated backing layers enter the well. In this way, the yarn will remain in the PVC and not pull out after the planting step. Thermocouples (not shown) can be provided under the guide plates 58 to control the dampers and maintain the temperature of the upper guide plates 58 at the desired level.

Dampers 66 are provided in the lower portion of the oven 20 so that fresh air can be introduced into the oven 20 for purging the gas fired heating elements and cooling during overheat. Exhaust ducts 68 are provided for transmitting exhaust gases out of the oven 20.

After the yarn sandwich passes through the oven 20 it enters the cooling unit 22 which is disclosed and described in detail in my pending application Ser. No. 425,890, filed Dec. 18, 1973 entitled "Cutter for Non-Woven Carpet Machine."

After the sandwich passes through the cooling unit 22 it is severed by means of a cutter 24. The carpet thus formed then passes over the stationary pipes 70, 72, the idler rollers 74, drive rollers 76, and idler roller 78, and the stationary pipe 80 and is wound on a roll-up roller (not shown).

The overall system for advancing the backing layers and yarn sandwich will now be described in detail. The drive rollers 76 have pins projecting from their outer surface like the pin rollers 52 and provide the controlling force for pulling the yarn sandwich through the well. The drive rollers 76 are driven at a stepped rate of speed. The pin rollers 52 operate as a brake on the drive rollers 76 and are driven by SCR drive-torque controlled motors of the type where the torque is set at a predetermined rate and the motors maintain that torque, which results in a nearly constant tension and rate of speed in the advancing webs of jute.

The rollers 40, 44, which drive each pair of conveyers 36 and 38, are in turn driven by a separate motor which is also self-adjusting and torque controlled. Both conveyers in each pair are driven by the same motor, the motor being directly connected through a drive chain (not shown) to one of the rollers 40, 44, and through a reversible gear box and drive chain (not shown) to the other roller. Thus, if the yarn sandwich is moving at a speed slower than that of the rollers 76 the pin roller motor will then speed up, which in turn causes the torque-controlled conveyer motor to speed up. On the other hand, if slack is created in the yarn sandwich or the backing layers as they move across the guide plate 58, then the pin roller will be slowed down by its motor and in turn the conveyers will be slowed down.

In addition, because of the double pinch operation of the conveyers as discussed above, and the engagement of the jute between the two conveyer belts 36, 38, the jute is pushed upward toward the top of the machine, as opposed to being pulled, which enables a lighter weight jute than previously feasible to be used. This way there is no tearing or pulling forces being exerted on the jute before it enters the well. After the PVC has been applied to the jute and the yarn sandwich is formed then the sandwich is pulled down through the well with the pin roller 52 acting as a brake on the drive roller 76.

It has been found that the jute stays aligned in the direction of movement as it travels between the conveyers 36, 38. However, as a safety precaution to insure that the jute retains its alignment, photo-electric eyes as shown schematically in FIG. 3 and designated by reference numeral 82 can be provided along either side of where the jute emerges from between the conveyers 36, 38, and is engaged by the pin rollers 52. Whenever the jute travels too far to one side, and trips an electric eye, the conveyers 36, 38, which engage the jute along the opposite edge, will be slowed down a predetermined amount until the jute is realigned. Alternatively, the conveyers 36, 38, on the edge of the tripped photo-electric eye could be speeded up. In this way, the jute is realigned and fed into the well along essentially the same path. In addition, limit switches (not shown) can be provided at a point beyond where the electric eyes are located so that if the jute becomes drastically misaligned it will trip the limit switch and stop the machine.

Thus, there is provided a non-woven carpet machine which increases the speed and efficiency of making non-woven carpeting and lowers production costs while maintaining a high quality product. It should be kept in mind that those skilled in the art will be able to make modifications and variations on the inventions disclosed herein and that all such modifications and variations are contemplated as falling within the scope of the appended claims.

I claim:

1. An improved yarn feeding mechanism for a non-woven carpet machine which includes feeding means for feeding strands of yarn to said machine, supply means for supplying said strands to the feeding means, advancing means for advancing a layer of backing material, application means for applying bonding material to one side of the layer of backing material, and embedding means including a pair of elongated wire-like members for embedding the strands in the bonding material after it is applied to the backing material, the improvement comprising a first roller with a groove in the outer surface thereof for receiving and guiding each strand, a second roller disposed parallel to the first roller and in engagement with the outer surface thereof for maintaining each strand in its respective groove, moving means for rotating said rollers and pulling the strands from the supply means and toward the embedding means, the moving means being synchronized with the advancing means and embedding means.

2. The improvement in claim 1, wherein the moving means includes means for driving the second roller.

3. The improvement in claim 2, wherein a third roller is provided and the second and third rollers are adapted frictionally to engage the strands therebetween to pull the strands from the supply means.

4. The improvement in claim 3, wherein the third roller is disposed upstream from the first and second rollers relative to the direction the strands move.

5. The improvement in claim 4, wherein the third roller is an idler roller.

* * * * *